US006404116B1

(12) United States Patent
Nakamura et al.

(10) Patent No.: US 6,404,116 B1
(45) Date of Patent: Jun. 11, 2002

(54) COLOR CATHODE RAY TUBE

(75) Inventors: Tomoki Nakamura, Mobara; Kazunari Noguchi, Chiba; Syoji Shirai, Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 71 days.

(21) Appl. No.: 09/665,168

(22) Filed: Sep. 19, 2000

(30) Foreign Application Priority Data

Sep. 22, 1999 (JP) ..... 11-268074

(51) Int. Cl.[7] ..... H01J 29/51
(52) U.S. Cl. ..... 313/414; 313/409
(58) Field of Search ..... 313/414, 412; 315/382.1

(56) References Cited

U.S. PATENT DOCUMENTS 6,100,630 A * 8/2000 Amano et al. ..... 313/414

* cited by examiner

*Primary Examiner*—Nimeshkumar D. Patel
*Assistant Examiner*—Thelma Sheree Clove

(74) *Attorney, Agent, or Firm*—Antonelli, Terry, Stout & Kraus, LLP

(57) ABSTRACT

An intermediate electrode at a middle voltage which takes a value between a focusing voltage and an anode voltage is disposed between a focusing electrode and an anode of an in-line type electron gun. The intermediate electrode has a single opening whose diameter in the horizontal direction (in-line direction) is greater than the diameter thereof in the direction perpendicular to the horizontal direction so as to allow three electron beams to pass therethrough. The intermediate electrode also has a plate electrode provided therein with three electron beam apertures which respectively allow three electron beams to pass therethrough. Inside of the focusing electrode, a plate electrode provided with three electron beam apertures is provided. Here, the relationship between a length Lc which is obtained by adding diameters in the horizontal direction of three electron beam apertures and the lengths in the horizontal direction of bridges disposed between neighboring electron beam apertures of the plate electrode mounted in this focusing electrode and a length Lm which is obtained by adding diameters in the horizontal direction of three electron beam apertures and the lengths in the horizontal direction of bridges disposed between neighboring electron beam apertures of a plate electrode mounted in the intermediate electrode is set to Lc>Lm.

13 Claims, 9 Drawing Sheets

COLOR CATHODE RAY TUBE

FIELD OF THE INVENTION

The present invention relates to a color cathode ray tube.

BACKGROUND OF THE INVENTION

The resolution of a color cathode ray tube largely depends on the dimension and shape of spots (beam spots) of electron beams formed on a phosphor surface. To obtain the high resolution, electrodes of an electron gun must be constituted such that beam spots possibly having the smallest diameter and a circular shape are formed.

On the other hand, the diameter of electron beams which pass through a main lens of the electron gun becomes larger corresponding to the increase of the beam current and the diameter of the beam spots also becomes larger depending on the spherical aberration of the main lens. When the diameter of the main lens is increased by enlarging the diameter of a neck portion which accommodates the electron gun (the neck diameter), the diameter of the beam spot can be made small. In this case, however, the deflection electric power is increased. Japanese Laid-Open Patent Publication 103752/1983 discloses a technique which can minimize the spherical aberration by setting the diameter of the main lens as large as possible without enlarging the neck diameter.

FIG. 10 is a cross-sectional schematic view of an in-line-type electron gun of the prior art taken along a tube axis thereof. This electron gun includes an electron beam generating part which is comprised of a cathode 1 (a center cathode) encasing a heater 1', a control electrode 2 and an accelerating electrode 3, a focusing electrode 4 provided with a plate electrode 5 therein, and an anode 6 provided with a plate electrode 7 therein. Here, the above-mentioned respective electrodes and anode are formed of tubular electrodes having an elliptical or oblong cross section.

FIG. 11A is a plan view of the plate electrode 5 which is provided to the inside of the focusing electrode 4 and FIG. 11B is a plan view of the plate electrode 7 provided to the inside of the anode 6. The focusing electrode 4 has a single opening 4' through which three electron beams are made to pass. The plate electrode 5 provided to the inside of the focusing electrode 4 includes three electron beam apertures consisting of a center beam aperture 5*c* and two side beam apertures 5*s*. The anode 6 also has a single opening 6' through which three electron beams are made to pass through. The plate electrode 7 provided to the inside of the anode 6 includes one center beam aperture 7*c* and two semi-elliptical side beam portions 7*s*.

In the electron gun having the above-mentioned constitution, thermal electrons emitted from three cathodes 1 heated by the heater 1' (here, only the heater 1' and the cathode 1 for the center beam shown ) are sucked to the control electrode 2 side due to a positive voltage Vg2 of 400–1000 V applied to the accelerating electrode 3 to form three electron beams. The three electron beams pass through an opening portion of the control electrode 2, subsequently pass through the opening portion of the accelerating electrode 3, and thereafter, pass through a main lens which is formed in an opposing gap defined between the focusing electrode 4 and the anode 6 while being accelerated by a positive voltage applied to the focusing electrode 4 and the anode 6.

Here, the electron beams receive a slight focusing action before entering the main lens due to a prefocusing lens formed between the accelerating electrode 3 and the focusing electrode 4 to which a focusing voltage Vf of approximately 5–10 kV is applied. An anode voltage Eb of approximately 20–35 kV is applied to the anode 6 through a shield cup 8. Due to the main lens formed by a potential difference between the focusing electrode 4 and the anode 6, the electron beams focus on a phosphor screen and form beam spots on the phosphor screen.

As described above, since the single electron beam openings 4', 6' of the main lens electrode, that is, of the focusing electrode 4 and the anode 6 are large, an electric field of a main lens electrode opposing portion deeply penetrates into the inside of the main lens electrode and hence, it becomes possible to obtain an advantageous effect that the opening portion is substantially enlarged, that is, the diameter of the main lens is enlarged compared to a normal cylindrical lens. The enlargement of the diameter of the main lens can reduce the spherical aberration of the main lens and can minimize the enlargement of beam spots caused by the spherical aberration so that excellent focusing characteristics can be obtained.

However, even with respect to the electron gun having such a constitution, the substantial enlargement of the diameter of the main lens is restricted by the dimension between points on the loci of three electron beams and a point on the above-mentioned single electron beam aperture of the main lens electrode which come closest to each other.

That is, among the distances from the end of the single beam aperture in the in-line direction (in the horizontal direction) or from the end of the single electron beam aperture in the direction perpendicular to the in-line direction to the loci of respective electron beams, or the distance from the end of the single electron beam aperture in the in-line direction to the loci of both side beams among electron beams, the shorter one corresponds to the radius of the main lens. Accordingly, there has been a problem with respect to the conventional electron gun that the effective diameter of the main lens is restricted.

SUMMARY OF THE INVENTION

In a color cathode ray tube of the present invention, an intermediate electrode to which a voltage set to a middle value between a focusing voltage and an anode voltage is applied is arranged between a focusing electrode and an anode of an in-line type electron gun, the intermediate electrode has a single opening having the diameters in the horizontal direction (in-line direction) greater than the diameter in the direction perpendicular to the horizontal direction and allowing three electron beams to pass therethrough and is provided with a plate electrode which has three electron beam apertures for allowing three electron beams to pass therethrough therein. In the inside of the focusing electrode of the electron gun of the color cathode ray tube according to the present invention, a plate electrode having three electron beam apertures is arranged. The relationship between the length Lc which is a value obtained by adding the diameters in the horizontal direction of the three electron beam apertures and the lengths in the horizontal direction of bridges disposed between neighboring electron beam apertures in the inside of the focusing electrode and the horizontal length Lm which is a value obtained by adding the diameters in the horizontal direction of the three electron beam apertures and the lengths in the horizontal direction of bridges disposed between neighboring electron beam apertures of the plate electrode in the inside of the intermediate electrode is set to Lc>Lm.

Due to such a constitution, the diameter of the main lens can be enlarged and the aberration can be reduced and hence, the color images having a high definition can be displayed.

Further, according to the color cathode ray tube of the present invention, the relationship between the length La which is a value obtained by adding the diameters in the horizontal direction of the three electron beam apertures and the lengths in the horizontal direction of bridges disposed between neighboring electron beam apertures of the plate electrode in the inside of the anode and the horizontal length Lm which is a value obtained by adding the diameters in the horizontal direction of the three electron beam apertures and the lengths in the horizontal direction of bridges disposed between neighboring electron beam apertures of the plate electrode in the inside of the intermediate electrode is set to La>Lm.

Further, according to the color cathode ray tube of the present invention, by setting the relationships between the above-mentioned La, Lm and Lc to Lc>Lm and La>Lm, the diameter of the main lens can be enlarged and the aberration can be reduced so that color images of high definition can be displayed.

DESCRIPTION OF THE PREFERRED EMBODIMENTS

Figure 1:
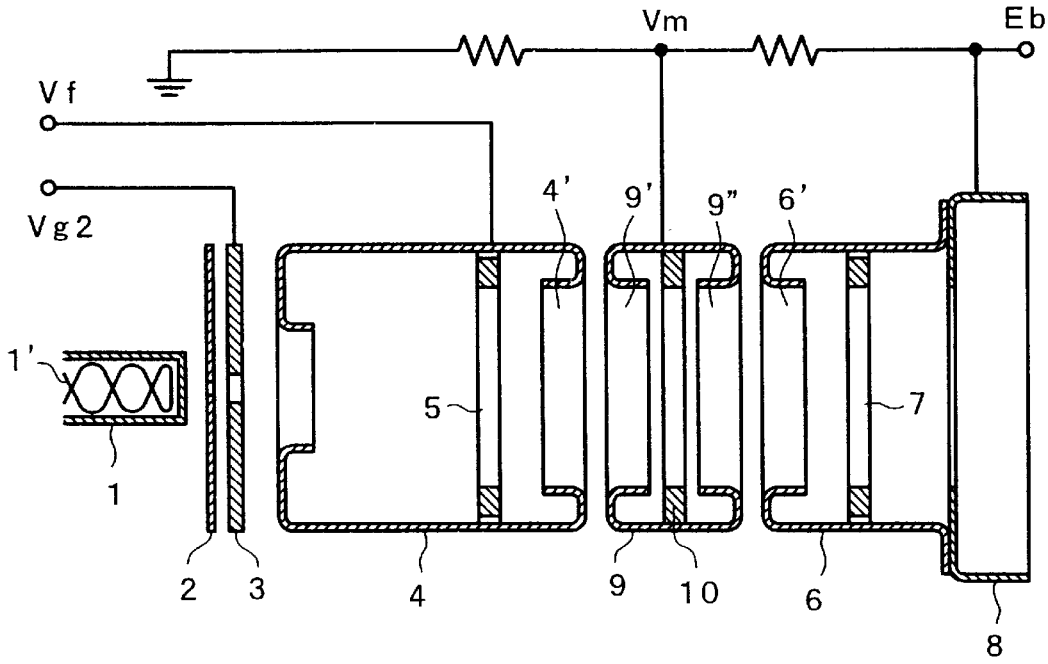
FIG. 1 is a cross-sectional schematic view of an electron gun used for a color cathode ray tube of the present invention cut in a vertical direction along a tube axis of the electron gun.
Figure 2A:
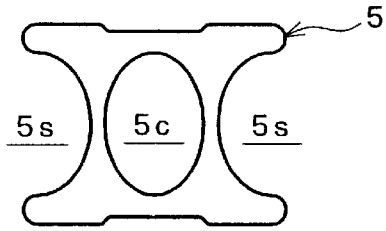
FIG. 2A to FIG. 2C are plan views of plate electrodes in the electron gun in FIG. 1.
Figure 2B:
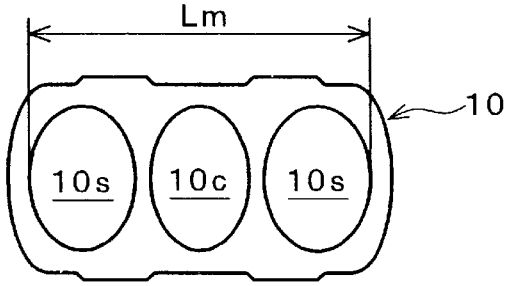
Figure 2C:
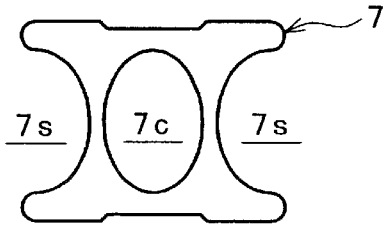

The present invention is explained in detail hereinafter with reference to embodiments. FIG. 1 is a cross-sectional schematic view cut in a vertical direction along a tube axis for explaining an electron gun used for a color cathode ray tube of the present invention. Further, FIG. 2A to FIG. 2C are plan views of plate electrodes in the electron gun shown in FIG. 1. FIG. 2A shows a plate electrode 5 provided to the inside of a focusing electrode 4, FIG. 2B shows a plate electrode 10 provided to an intermediate electrode 9, and FIG. 2C shows a plate electrode 7 provided to the inside of an anode 6.

The focusing electrode 4 has a single opening 4' whose diameters in the horizontal direction is greater than the diameter in the direction perpendicular to the horizontal direction and allows three electron beams to pass therethrough. The plate electrode 5 provided to the inside of the focusing electrode 4 has a center beam aperture 5*c* and two side beam passing portions 5*s* having a semi-elliptical shape. The intermediate electrode 9 also has single opening 9',9" whose diameters in the horizontal direction are greater than the diameter in the direction perpendicular to the horizontal direction and allow three electron beams to pass therethrough. The plate electrode 10 provided to the inside of the intermediate electrode 9 has a center beam aperture 10*c* and two side beam apertures 10*s*. Further, the anode 6 has a single opening 6' whose diameter in the horizontal direction is greater than the diameter in the direction perpendicular to the horizontal direction and allows three electron beams to pass therethrough. The plate electrode 7 provided to the inside of the anode 6 has one center beam aperture 7*c* and two side beam passing portions 7*s* having a semi-elliptical shape.

Opening surfaces of the focusing electrode 4, the intermediate electrode 9 and the anode 6 which face each other in an opposed manner are all provided for forming one opening surface which surrounds three electron beams and hence, a lens electric field common to three electron beams is formed.

A focusing voltage Vf is applied to the focusing electrode 4, an anode voltage Eb is applied to the anode 6 and a voltage Vm which takes a middle value between the anode voltage Eb and the focusing voltage Vf is applied to the intermediate electrode 9. This voltage Vm is supplied by dividing the anode voltage Eb with resistance.

Figure 3:
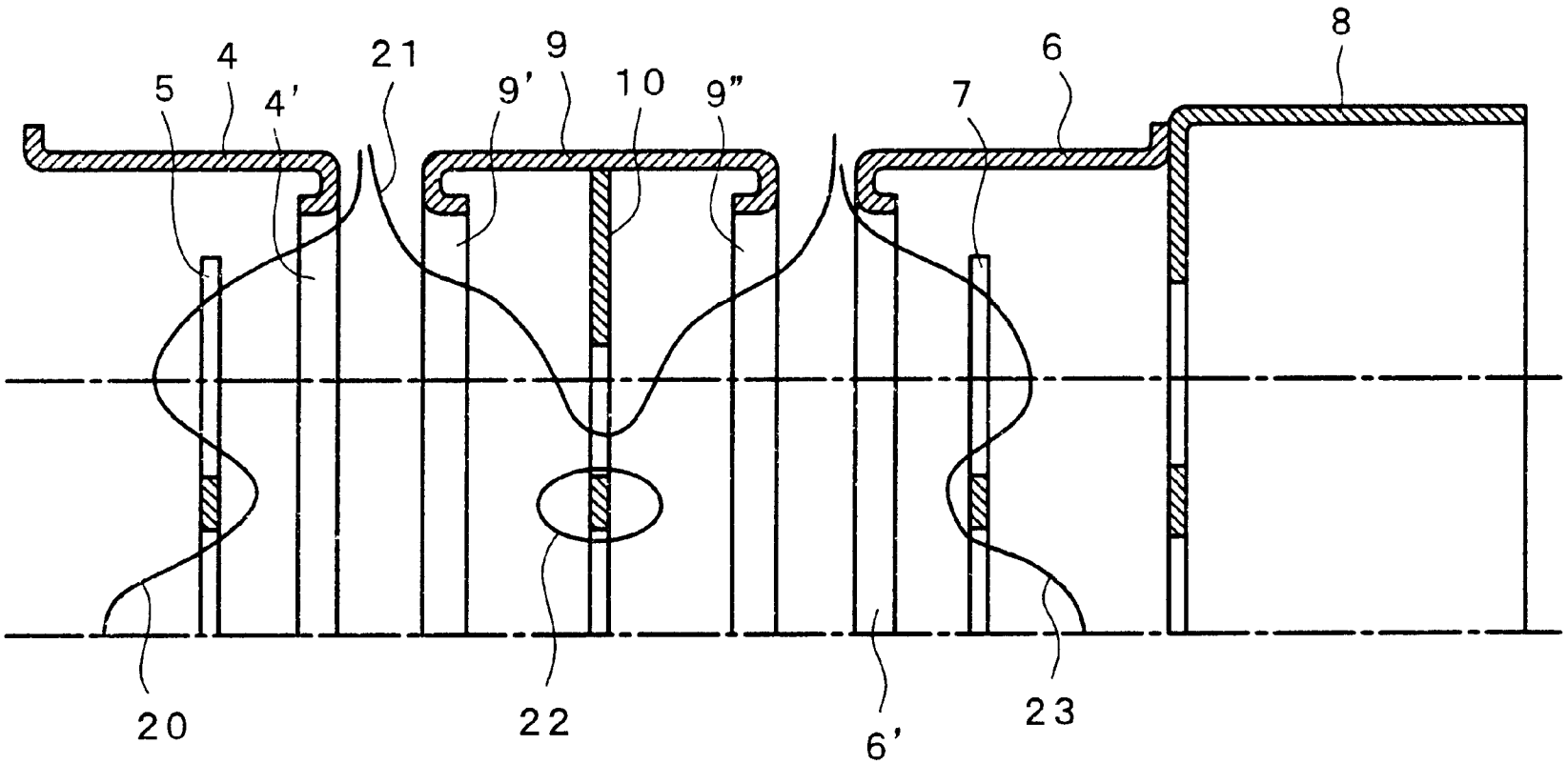
FIG. 3 is an explanatory view showing equipotential lines of a main lens portion in the electron gun in FIG. 1.

FIG. 3 is an explanatory view showing equipotential lines of a main lens portion in the electron gun shown in FIG. 1. In FIG. 3, curved lines indicated by numerals 20, 21, 22, 23 are equipotential lines. As can be understood from these equipotential lines, the focusing action applied to the side beams takes the highest value at the intermediate electrode 9 to obtain the static convergence (STC).

Figure 4:
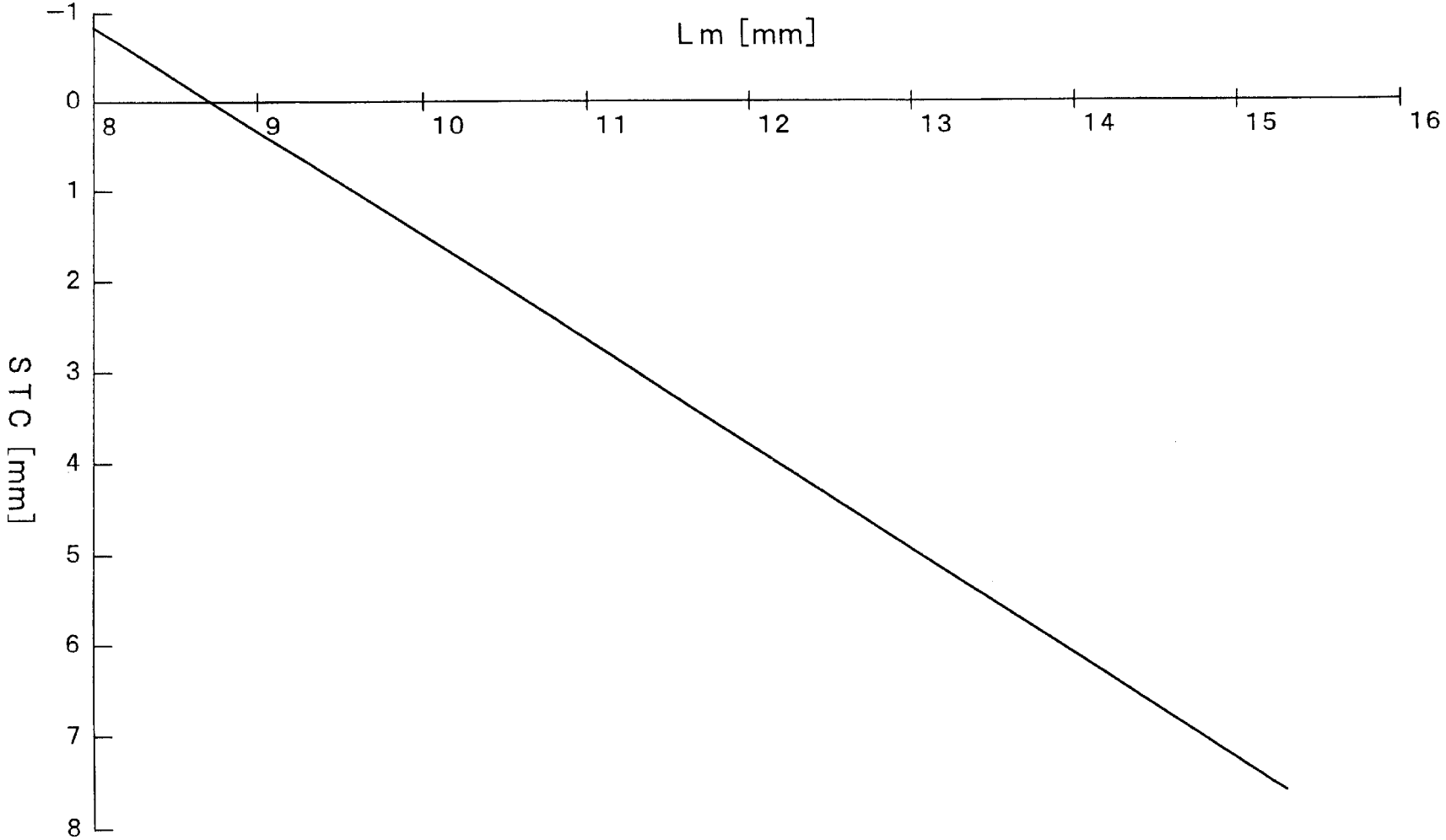
FIG. 4 is an explanatory view showing the relationship between a value (mm) of the length Lm which is obtained by adding the diameters in the horizontal direction of three electron beam apertures and the lengths in the horizontal direction of bridges disposed between neighboring electron beam apertures of the plate electrode mounted in an intermediate electrode of the electron gun and a value (mm) of STC.

FIG. 4 is an explanatory view showing the relationship between a value (mm) of the length Lm which is obtained by adding the diameters in the horizontal direction of three electron beam apertures and the lengths in the horizontal direction of bridges disposed between neighboring electron beam apertures of the plate electrode mounted in the intermediate electrode of the electron gun of the present invention and a value (mm) of the STC. FIG. 4 is prepared by a computer simulation under the condition that anode voltage Eb is set to 26 kV.

From the relationship shown in FIG. 4, it is understood that when the focusing action to the side beams is amplified by shortening the above-mentioned length Lm, the STC can be made small. Here, since the focusing action to the side beams is determined by the shape of the plate electrode of the intermediate electrode and the potential of the intermediate electrode, the substantially receives no influence which may be brought about by some eccentricity of the plate electrode in the focusing electrode or the fluctuation of the focusing voltage.

Figure 5A:
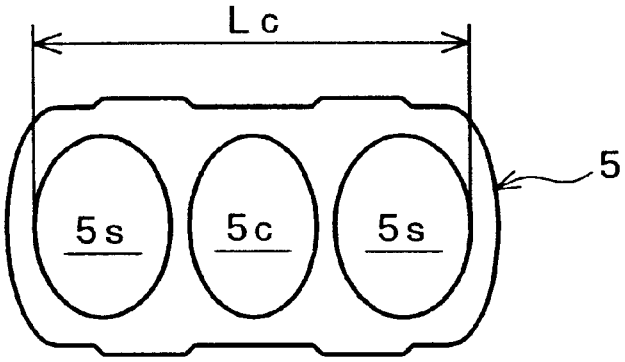
FIG. 5A to FIG. 5C are plan views of plate electrodes for explaining the first embodiment of the electron gun used for the color cathode ray tube of the present invention.
Figure 5B:
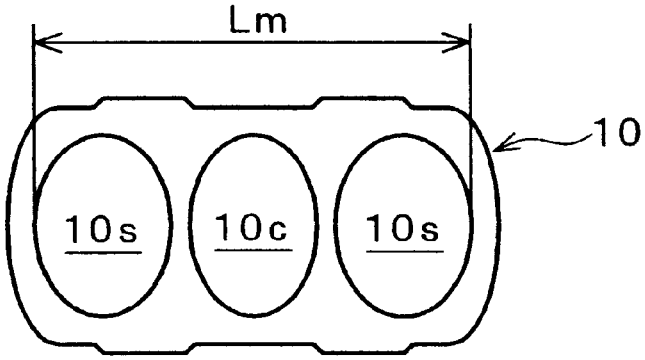
Figure 5C:
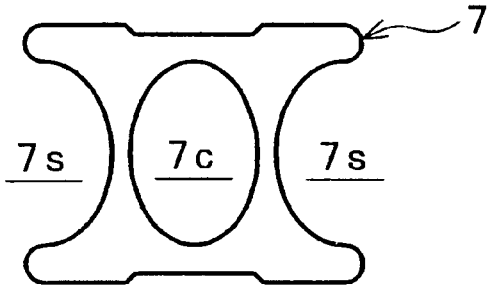

FIG. 5A to FIG. 5C are plan views showing plate electrodes of the electron gun of the first embodiment used for the color cathode ray tube of the present invention. FIG. 5A shows the plate electrode mounted in the inside of the focusing electrode 4 shown in FIG. 1, FIG. 5B shows the plate electrode mounted in the inside of the intermediate electrode 9 shown in FIG. 1, and FIG. 5C shows the plate electrode mounted in the inside of the anode 6 shown in FIG. 1. In this embodiment, the plate electrode 5 mounted in the inside of the focusing electrode 4 is made of an electrode having three electron beam apertures 5*c*, 5*s* through which three electron beams pass respectively.

The electrode which gives the largest influence to the STC is the plate electrode 10 mounted in the intermediate electrode 9. In this embodiment, between the value (mm) of the length Lc which is obtained by adding the diameters in the horizontal direction of three electron beam apertures 5*c*, 5*s* of the plate electrode 5 and the lengths in the horizontal direction of bridges disposed between neighboring electron beam apertures 5*c*, 5*s* mounted in the focusing electrode 4 and the value (mm) of the length Lm which is obtained by adding the diameters in the horizontal direction of three electron beam apertures 10*c*, 10*s* and the lengths in the horizontal direction of bridges disposed between neighboring electron beam apertures 10*c*, 10*s* of the plate electrode 10 mounted in the intermediate electrode 9, the relationship Lc>Lm is set. Here, it is preferable that the respective lengths Lc, Lm fall within 38% to 70% of an outer diameter of a neck portion.

By setting the relationship to Lc>Lm, the relationship shown in FIG. 4 can be also established with respect to this embodiment and hence, by decreasing the value of the Lm, the focusing action to the side beams is amplified and it becomes possible to reduce the STC. Further, in this case, since the focusing action is determined by the shape of the plate electrode mounted in the inside of the intermediate electrode and the potential of the intermediate electrode, the STC substantially receives no fluctuation brought about-by the focusing electrode. According to this embodiment, the diameter of the main lens is substantially enlarged and the aberration can be reduced and hence, the color Image display of high definition can be realized.

Figure 6A:
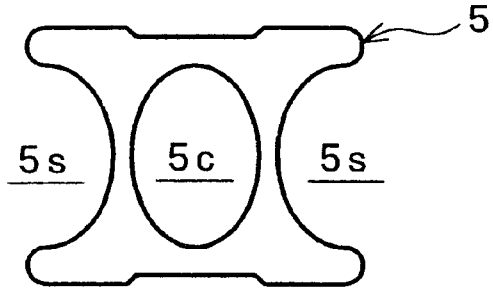
FIG. 6A to FIG. 6C are plan views of plate electrodes for explaining the second embodiment of the electron gun used for the color cathode ray tube of the present invention.
Figure 6B:
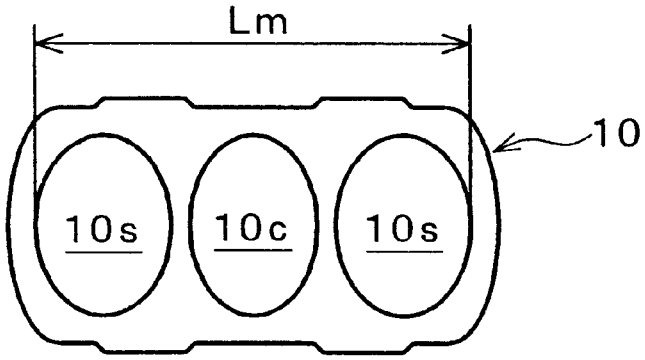
Figure 6C:
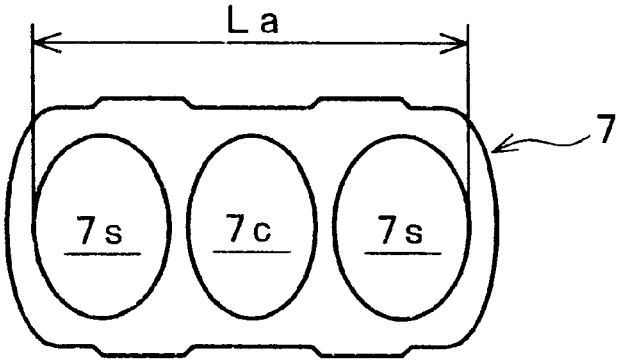

FIG. 6A to FIG. 6C are plan views of plate electrodes of the electron gun of the second embodiment used for the color cathode ray tube of the present invention. FIG. 6A shows the plate electrode mounted in the inside of the focusing electrode 4 shown in FIG. 1, FIG. 6B shows the plate electrode mounted in the inside of the intermediate electrode 9 shown in FIG. 1, and FIG. 6C shows the plate electrode mounted in the inside of the anode 6 shown in FIG. 1.

In this embodiment, the plate electrode 5 mounted in the inside of the focusing electrode 4 has one electron beam aperture 5*c* which allow the center beam to pass therethrough and two semi-elliptical side beam portions 5*s* which allow the side beams to pass therethrough, while the plate electrode 7 mounted in the inside of the anode 6 has three electron beam apertures 7*c*, 7*s* which allow three electron beams to pass therethrough respectively.

Since the focusing action to the side beams is determined by the shape of the plate electrode mounted in the inside of the intermediate electrode and the potential of the intermediate electrode, the STO is not substantially affected by fluctuation of the focusing voltage of the focusing electrode. The electrode which gives the largest influence to the STC is the plate electrode 10 mounted in the intermediate electrode 9. In this embodiment, between the value (mm) of the length Lm which is obtained by adding the diameters in the horizontal direction of three electron beam apertures 10*c*, 10*s* and the lengths in the horizontal direction of bridges disposed between neighboring electron beam apertures 10*c*, 10*s* of the plate electrode 10 mounted in the intermediate electrode 9 and the value (mm) of the length La which is obtained by adding the diameters in the horizontal direction of three electron beam apertures 7*c*, 7*s* of the plate electrode 7 and the lengths in the horizontal direction of bridges disposed between neighboring electron beam apertures 7*c*, 7*s* mounted in the anode 6, the relationship La>Lm is set. Here, it is preferable that the respective lengths La, Lm fall within 38% to 70% of the outer diameter of the neck portion.

The relationship shown in FIG. 4 can be also established with respect to this embodiment and hence, by decreasing the value of the Lm, the focusing action to the side beams is amplified and it becomes possible to reduce the STC. Further, in this embodiment, the diameter of the main lens is substantially enlarged and the aberration can be reduced and hence, the color image display of high definition can be realized.

Figure 7A:
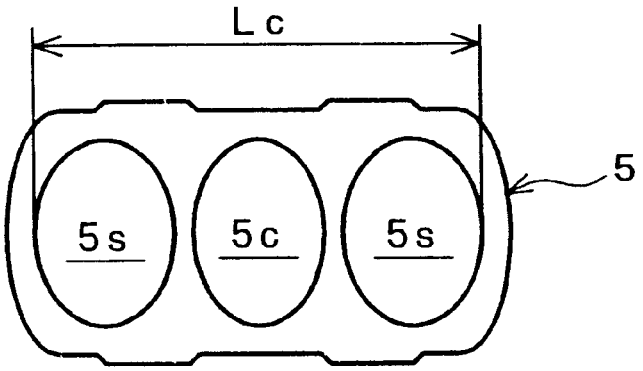
FIG. 7A to FIG. 7C are plan views of plate electrodes for explaining the third embodiment of the electron gun used for the color cathode ray tube of the present invention.
Figure 7B:
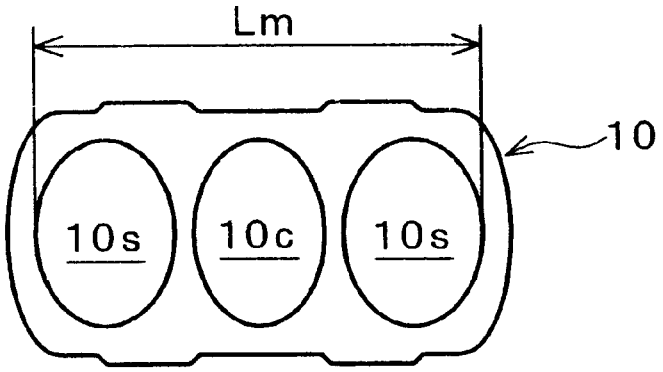
Figure 7C:
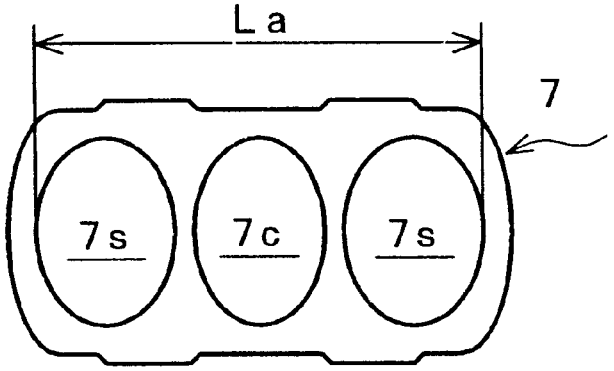

FIG. 7A to FIG. 7C are plan views of plate electrodes of the electron gun of the third embodiment used for the color cathode ray tube of the present invention. FIG. 7A shows the plate electrode mounted in the inside of the focusing electrode 4 shown in FIG. 1, FIG. 7B shows the plate electrode mounted in the inside of the intermediate electrode 9 shown in FIG. 1, and FIG. 7C shows the plate electrode mounted in the inside of the anode 6 shown in FIG. 1.

In this embodiment, all of the plate electrodes 5, 10, 7 respectively it mounted in the inside of the focusing electrode 4, the intermediate electrode 9 and the anode 6 are made of electrodes which respectively have three electron beam apertures which allow three electron beams to pass therethrough. In this embodiment, among the value (mm) of the length Lc which is obtained by adding the diameters in the horizontal direction of three electron beam apertures 5*c*, 5*s* and the lengths in the horizontal direction of bridges disposed between neighboring electron beam apertures 5*c*, 5*s* of the plate electrode 5 mounted in the focusing electrode 4, the value (mm) of the length Lm which is obtained by adding the diameters in the horizontal direction of three electron beam apertures 10*c*, 10*s* and the lengths in the horizontal direction of bridges disposed between neighboring electron beam apertures 10*c*, 10*s* of the plate electrode 10 mounted in the intermediate electrode 9 and the value (mm) of the length La which is obtained by adding the diameters in the horizontal direction of three electron beam apertures 7*c*, 7*s* and the lengths in the horizontal direction of bridges disposed between neighboring electron beam apertures 7*c*, 7*s* of the plate electrode 7 mounted in the anode 6, the relationship La>Lm and Lc>Lm is set. Here, it is preferable that the respective lengths La, Lc, Lm respectively fall within 38% to 70% of the outer diameter of the neck portion.

In this embodiment, the electrode which give the largest influence to the STC is the plate electrode 10 mounted in the intermediate electrode 9 and the relationship shown in FIG. 4 can be established. By decreasing the value of the Lm, the focusing action to the side beams is amplified and It becomes possible to reduce the STC. Here, since the focusing action is determined by the shape of the plate electrode mounted in the inside of the intermediate electrode and the potential of the intermediate electrode, the STC substantially receives no influence from the focusing electrode. Further, in this embodiment, the diameter of the main lens can be also substantially enlarged and the aberration can be reduced and hence, the color image display of high definition can be realized.

Figure 8:
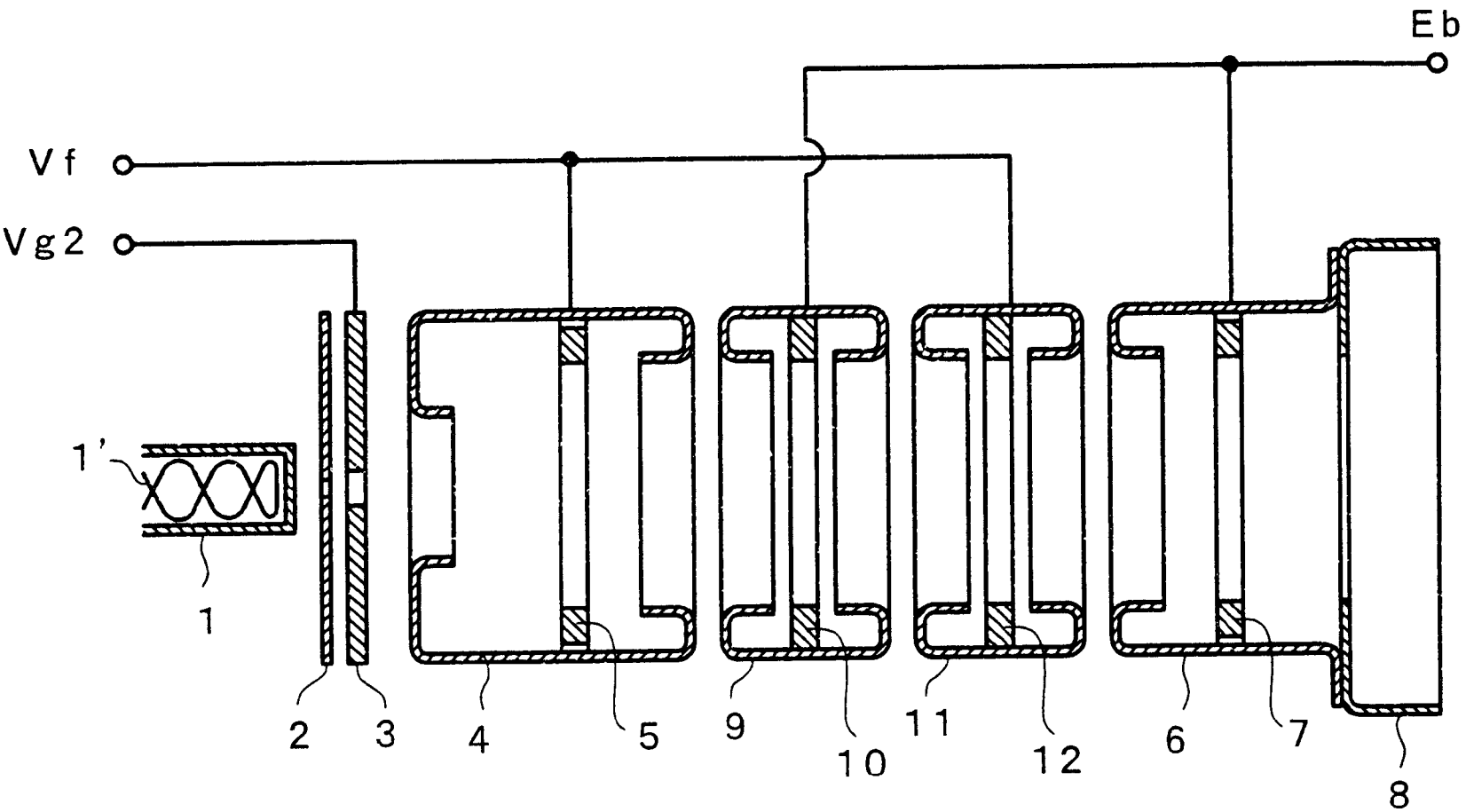
FIG. 8 is a cross-sectional schematic view for explaining an electron gun of the fourth embodiment used for a color cathode ray tube of the present invention cut in a vertical direction along a tube axis of the electron gun.

FIG. 8 is a cross-sectional schematic view cut in the vertical direction along the tube axis for explaining the fourth embodiment of the electron gun used in the color cathode ray tube of the present invention. In this embodiment, two intermediate electrodes are provided and plate electrodes are mounted in the inside of respective intermediate electrodes. That is, in this embodiment, the intermediate electrode is constituted by a first intermediate electrode 9 and a second intermediate electrode 11, wherein a plate electrode 10 is mounted in the inside of the first intermediate electrode 9 and a plate electrode 12 is mounted in the inside of the second intermediate electrode 11. An anode voltage Eb is applied to the first intermediate electrode 9 and a focusing voltage Vf is applied to the second intermediate electrode 11.

In this embodiment, the plate electrodes 10, 12 mounted in the inside of the first and second intermediate electrodes 9, 11 have three electron beam apertures which respectively allow three electron beams to pass therethrough. Plate electrodes 5, 7 mounted in a focusing electrode 4 and an anode 6 may be any of those explained in the first to third embodiments. In this embodiment, among the plate electrodes 5, 10, 12, 7 which are mounted in the focusing electrode 4, the first intermediate electrode 9, the second intermediate electrode 11 and the anode 6, with respect to the value of Lc or La of the plate electrode 5 or 7 mounted in the focusing electrode 4 or the anode 6 relative to the value of Lm (Lm of respective plate electrodes either being same or different from each other) of the plate electrodes 10, 12 mounted in the first intermediate electrode 9 and the second intermediate electrode 11, it is sufficient if the relationship La>Lm, Lc>Lm or La>Lm and Lc>Lm is established. This goes for a case where more than 2 plate electrodes are provided. In this case, the Lm is represented by the longest Lm among Lms of respective electrodes in this embodiment, it is also preferable that the La, Lc, Lm fall within 38% to 70% of the outer diameter of the neck portion.

The shape of plate electrodes mounted in the focusing electrode or the anode in respective embodiments may be enough if the shape includes the electron beam aperture for the center beam and notches or openings having other shapes for allowing side beams to pass therethrough at both sides of the electron beam aperture. The shape of the notches or openings is not limited to the semi-elliptical shape shown in respective embodiments. Further, with respect to the electron gun having more than 2 intermediate electrodes, it is sufficient if the above-mentioned dimensional relationship among La, Lc and Lm is met. Here, in the case that the electron gun has more than two intermediate electrodes, Lm may be represented by the longest Lm among Lms of respective plate electrodes. In this embodiment, the diameter of the main lens can be also substantially enlarged and the aberration can be also decreased and hence, the color images of high definition can be obtained.

Figure 9:
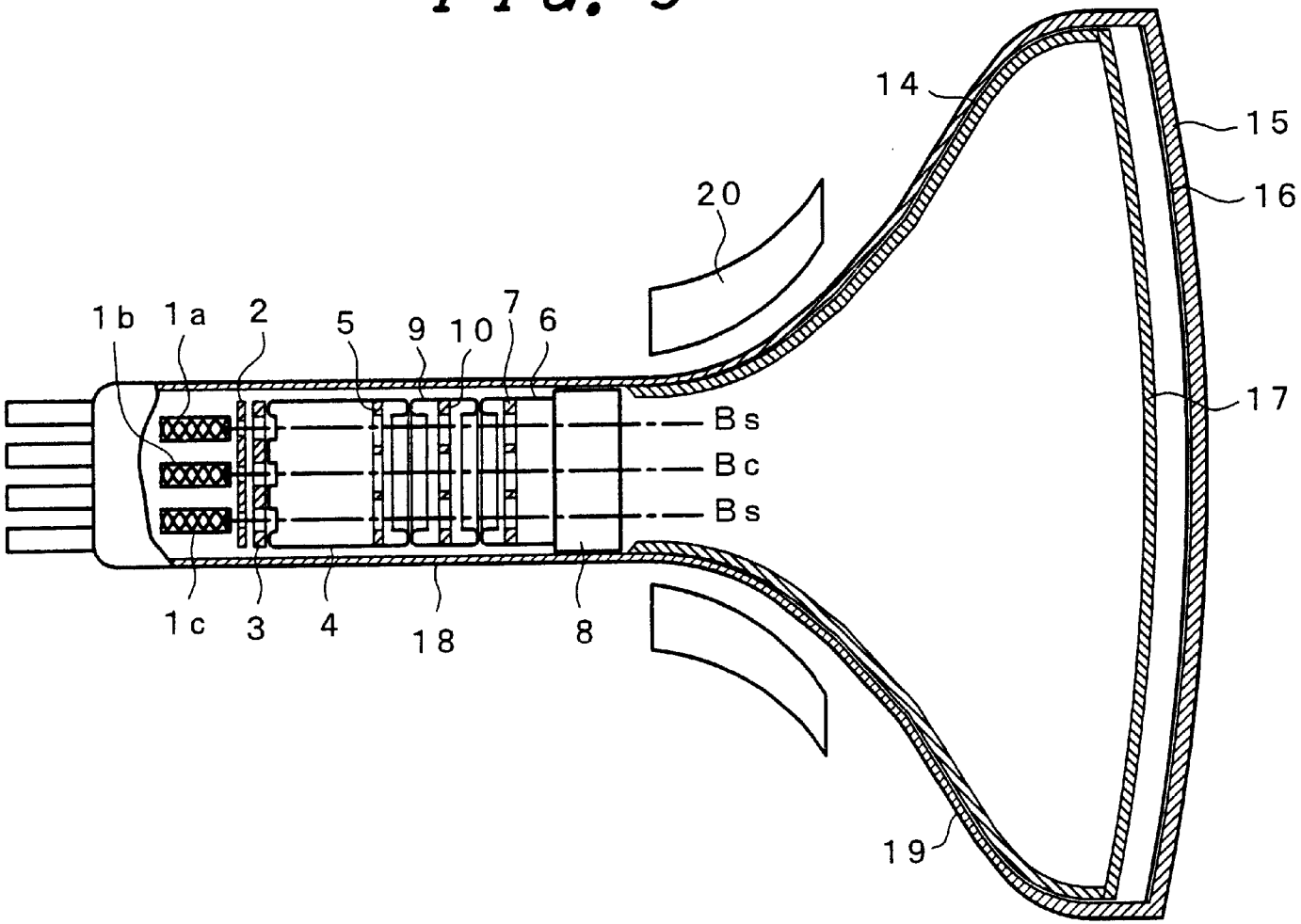
FIG. 9 is a cross-sectional view for explaining an example of the whole constitution of a color cathode ray tube of the present invention taken along a tube axis of the color cathode ray tube.
Figure 10:
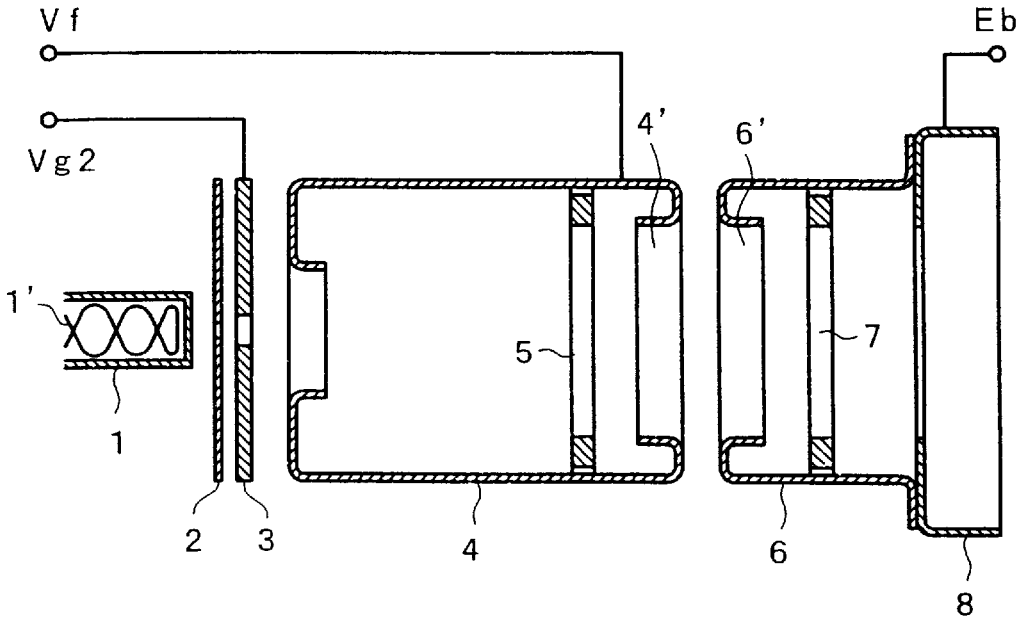
FIG. 10 (PRIOR ART)
FIG. 10 is a cross-sectional schematic view of a color cathode ray tube taken along the tube axis of the color cathode ray tube showing the schematic structure of a conventional in-line type electron gun.
Figure 11A:
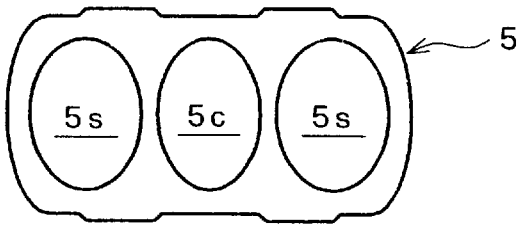
FIG. 11A (PRIOR ART)
FIG. 11A and FIG. 11B are plan views of the plate electrodes in FIG. 10.
Figure 11B:
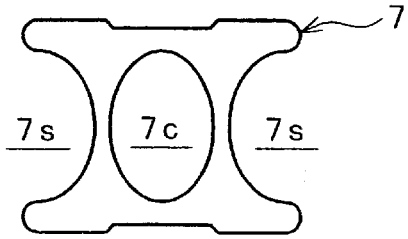
FIG. 11B (PRIOR ART)

FIG. 9 is a cross-sectional view taken along a tube axis showing an example of the entire constitution of a color cathode ray tube having an effective screen size of 19 inches, the polarization of 90° and a horizontal pitch of phosphor dots at the center of a phosphor screen of 0.24 mm to which the present invention is applied. This color cathode ray tube includes a vacuum; envelope which is comprised of a panel portion 15 which constitutes a phosphor screen 16, a neck portion 18 which accommodates an electron gun and a funnel portion 19 which connects the panel portion 15 and the neck portion 18. A deflection yoke 20 is mounted on the neck portion 18 side of the funnel portion 19. Further, in the inside of the panel portion 15, a shadow mask 17 which is disposed adjacent to the phosphor screen 16 and works as a color selection electrode is suspended from an inner wall of the panel 15. Numeral 14 in FIG. 9 indicates an interior conductive film.

The electron gun accommodated in the neck portion 18 is comprised of electron beam generating means which includes three cathodes 1*a*, 1*b*, 1*c* irradiating three electron beams (center beam Bc and electron beams Bs×2 at both sides), a control electrode 2 and an accelerating electrode 3, a focusing electrode 4 having a plate electrode 5, an anode 6 having a plate electrode 7, and an intermediate electrode 9 having a plate electrode 10 between the focusing electrode 4 and the anode 6. The plate electrode 10 mounted in the intermediate electrode 9 has three electron beam apertures which allow three electron beams to pass therethrough. Further, the plate electrode 5, 7 respectively mounted in the focusing electrode 4 and the anode 6 are identical with those explained in the above-mentioned embodiments. Although an inner magnetic shield which shields an earth magnetism by surrounding an electron beam scanning space in the funnel portion 19 is mounted, such shield is omitted in FIG. 9.

Further, although, in general, the outer diameter of the neck portion 18 is ϕ29.1 mm, a color cathode ray tube having the outer diameter of equal to or less than ϕ25.3 mm may become necessary for reducing the deflection electric power. The restriction of the lens diameter of the main lens is particularly serious when the outer diameter of the neck portion is small. The present invention is particularly advantageous to a color cathode ray tube whose neck portion has the outer diameter of equal to or less than 25.3 mm. It is needless to say that the present invention is applicable to a color cathode ray tube having an effective screen size of less than 19 inches, for example, of 17 inches or 15 inches, or a color cathode ray tube having a deflection angle of more than 90°, for example, of 100°, or a color cathode ray tube having a horizontal dot pitch on a phosphor screen of less than 0.24 mm.

What is claimed is:

1. A color cathode ray tube including a vacuum envelope which is comprised of a panel portion constituting a phosphor screen, a neck portion accommodating an electron gun and a funnel portion connecting the panel portion and the neck portion, wherein said electron gun is an in-line type electron gun which includes electron beam generating means comprising cathodes irradiating three electron beams approximately in parallel toward said phosphor screen on one horizontal plane, a control electrode and an accelerating electrode, a focusing electrode having a single opening whose diameter in the direction parallel to said horizontal plane is greater than a diameter thereof in the direction perpendicular to said horizontal plane so as to allow said three electron beams to pass therethrough, said focusing electrode having a plate electrode provided with three electron beam apertures which allow said respective electron beams to pass therethrough therein, said focusing electrode being applied with a focusing voltage, an anode having a single opening whose diameter in the direction parallel to said horizontal plane is greater than a diameter thereof in the direction perpendicular to said horizontal plane so as to allow said three electron beams to pass therethrough, said anode having a plate electrode provided with a single electron beam aperture which allows a center beam of said three electron beams to pass therethrough therein, said anode constituting a main lens on a surface thereof which faces said focusing electrode, said anode being applied with an anode voltage, and at least one intermediate electrode being disposed between said focusing electrode and said anode, said intermediate electrode having a single opening whose diameter in the direction parallel to said horizontal plane is greater than a diameter thereof in the direction perpendicular to said horizontal plane so as to allow said three electron beams to pass therethrough, said intermediate electrode having a plate electrode provided with three electron beam apertures which allow said respective three electron beams to pass therethrough therein, said intermediate electrode being applied with a middle voltage which takes a value between said focusing voltage and said anode voltage, and when a length which is obtained by adding diameters in the horizontal direction of said three electron beam apertures and lengths in the horizontal direction of bridges disposed between neighboring electron beam apertures of said plate electrode mounted in the inside of said focusing electrode is set as Lc, and a length which is obtained by adding diameters in the horizontal direction of three electron beam apertures and lengths in the horizontal direction of bridges disposed between neighboring electron beam apertures of said plate electrode mounted in the inside of said intermediate electrode is set as Lm, the relationship between Lc and Lm is set to Lc>Lm.

2. A color cathode ray tube according to claim 1, wherein a horizontal dot pitch at the center of said phosphor screen is set to equal to or less than 0.24 mm.

3. A color cathode ray tube according to claim 1, wherein said length Lm which is obtained by adding diameters in the horizontal direction of three electron beam apertures and lengths in the horizontal direction of bridges disposed between neighboring electron beam apertures of said plate electrode mounted in the inside of said intermediate electrode is 38%–70% of an outer diameter of said neck portion.

4. A color cathode ray tube according to claim 1, wherein said length Lc which is obtained by adding diameters in the horizontal direction of three electron beam apertures and lengths in the horizontal direction of bridges disposed between neighboring electron beam apertures of said plate electrode mounted in the inside of said focusing electrode is 38%–70% of an outer diameter of said neck portion.

5. A color cathode ray tube including a vacuum envelope which is comprised of a panel portion constituting a phosphor screen, a neck portion accommodating an electron gun and a funnel portion connecting the panel portion and the neck portion, wherein said electron gun is an in-line type electron gun which includes electron beam generating means comprising cathodes irradiating three electron beams approximately in parallel toward said phosphor screen on one horizontal plane, a control electrode and an accelerating electrode, a focusing electrode having a single opening whose diameter in the direction parallel to said horizontal plane is greater than a diameter thereof in the direction perpendicular to said horizontal plane so as to allow said three electron beams to pass therethrough, said focusing electrode having a plate electrode provided with one electron beam aperture which allows a center beam of said electron beams to pass therethrough therein, said focusing electrode being applied with a focusing voltage, an anode having a single opening whose diameter in the direction parallel to said horizontal plane is greater than a diameter thereof in the direction perpendicular to said horizontal plane so as to allow said three electron beams to pass therethrough, said anode having a plate electrode provided with three electron beam apertures which allow said respective electron beams to pass therethrough therein, said anode constituting a main lens on a surface thereof which faces said focusing electrode, said anode being applied with an anode voltage, and at least one intermediate electrode being disposed between said focusing electrode and said anode, said intermediate electrode having a single opening whose diameter in the direction parallel to said horizontal plane is greater than a diameter thereof in the direction perpendicular to said horizontal plane so as to allow said three electron beams to pass therethrough, said intermediate electrode having a plate electrode provided with three electron beam apertures which allow said respective three electron beams to pass therethrough therein, said intermediate electrode being applied with a middle voltage which takes a value between said focusing voltage and said anode voltage, and when a length which is obtained by adding diameters in the horizontal direction of said three electron beam apertures and lengths in the horizontal direction of bridges disposed between neighboring electron beam apertures in said plate electrode of said plate electrode mounted in the inside of said anode is set as La, and a length which is obtained by adding diameters in the horizontal direction of three electron beam apertures and lengths in the horizontal direction of bridges disposed between neighboring electron beam apertures of said plate electrode mounted in the inside of said intermediate electrode is set as Lm, the relationship between La and Lm is set to La>Lm.

6. A color cathode ray tube according to claim 5, wherein a horizontal dot pitch at the center of said phosphor screen is set to equal to or less than 0.24 mm.

7. A color cathode ray tube according to claim 5, wherein said length Lm which is obtained by adding diameters in the horizontal direction of three electron beam apertures and lengths in the horizontal direction of bridges disposed between neighboring electron beam apertures of said plate electrode mounted in the inside of said intermediate electrode is 38%–70% of an outer diameter of said neck portion.

8. A color cathode ray tube according to claim 5, wherein said length La which is obtained by adding diameters in the horizontal direction of three electron beam apertures and lengths in the horizontal direction of bridges disposed between neighboring electron beam apertures of said plate electrode mounted in the inside of said anode is 38%–70% of an outer diameter of said neck portion.

9. A color cathode ray tube including a vacuum envelope which is comprised of a panel portion constituting a phosphor screen, a neck portion accommodating an electron gun and a funnel portion connecting the panel portion and the neck portion, wherein said electron gun is an in-line type electron gun which includes electron beam generating means comprising cathodes irradiating three electron beams approximately in parallel toward said phosphor screen on one horizontal plane, a control electrode and an accelerating electrode, a focusing electrode having a single opening whose diameter in the direction parallel to said horizontal plane is greater than a diameter thereof in the direction perpendicular to said horizontal plane so as to allow said three electron beams to pass therethrough, said focusing electrode having a plate electrode provided with three electron beam apertures which allow said respective electron beams to pass therethrough therein, said focusing electrode being applied with a focusing voltage, an anode having a single opening whose diameter in the direction parallel to said horizontal plane is greater than a diameter thereof in the direction perpendicular to said horizontal plane so as to allow said three electron beams to pass therethrough, said anode having a plate electrode provided with three electron beam apertures which allow said respective electron beams to pass therethrough therein, said anode constituting a main lens on a surface thereof which faces said focusing electrode, said anode being applied with an anode voltage, and at least one intermediate electrode being disposed between said focusing electrode and said anode, said intermediate electrode having a single opening whose diameter in the direction parallel to said horizontal plane is greater than a diameter thereof in the direction perpendicular to said horizontal plane so as to allow said three electron beams to pass therethrough, said intermediate electrode having a plate electrode provided with three electron beam apertures which allow said respective three electron beams to pass therethrough therein, said intermediate electrode being applied with a middle voltage which takes a value between said focusing voltage and said anode voltage, and when a length which is obtained by adding diameters in the horizontal direction of said three electron beam apertures and lengths in the horizontal direction of bridges disposed between neighboring electron beam apertures of said plate electrode mounted in the inside of said focusing electrode is set as Lc, a length which is obtained by adding diameters in the horizontal direction of said three electron beam apertures and lengths in the horizontal direction of bridges disposed between neighboring electron beam apertures of said plate electrode mounted in the inside of said anode is set as La, and a length which is obtained by adding diameters in the horizontal direction of three electron beam apertures and lengths in the horizontal direction of bridges-disposed between neighboring electron beam apertures of said plate electrode mounted in the inside of said intermediate electrode is set as Lm, the relationship between La, Lm and Lc is set to Lc>Lm and La>Lm.

10. A color cathode ray tube according to claim 9, wherein a horizontal dot pitch at the center of said phosphor screen is set to equal to or less than 0.24 mm.

11. A color cathode ray tube according to claim 9, wherein said length Lm which is obtained by adding diameters in the horizontal direction of three electron beam apertures and lengths in the horizontal direction of bridges disposed between neighboring electron beam apertures of said plate electrode mounted in the inside of said intermediate electrode is 38%–70% of an outer diameter of said neck portion.

12. A color cathode ray tube according to claim 9, wherein said length La which is obtained by adding diameters in the horizontal direction of three electron beam apertures and lengths in the horizontal direction of bridges disposed between neighboring electron beam apertures of said plate electrode mounted in the inside of said anode is 38%–70% of an outer diameter of said neck portion.

13. A color cathode ray tube according to claim 9, wherein said length Lc which is obtained by adding diameters in the horizontal direction of three electron beam apertures and lengths in the horizontal direction of bridges disposed between neighboring electron beam apertures of said plate electrode mounted in the inside of said focusing electrode is 38%–70% of an outer diameter of said neck portion.

* * * * *